US009632469B2

(12) United States Patent
Nakashima

(10) Patent No.: US 9,632,469 B2
(45) Date of Patent: Apr. 25, 2017

(54) IMAGE FORMING APPARATUS THAT OBTAINS MISREGISTRATION AMOUNT FROM DETECTION RESULT OF DETECTION PATTERN

(71) Applicant: CANON KABUSHIKI KAISHA, Tokyo (JP)

(72) Inventor: Satoshi Nakashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/663,861

(22) Filed: Mar. 20, 2015

(65) Prior Publication Data

US 2015/0277262 A1 Oct. 1, 2015

(30) Foreign Application Priority Data

Apr. 1, 2014 (JP) ..... 2014-075730

(51) Int. Cl.
*G03G 15/16* (2006.01)
*G03G 15/00* (2006.01)

(52) U.S. Cl.
CPC . *G03G 15/5058* (2013.01); *G03G 2215/0132* (2013.01); *G03G 2215/0161* (2013.01)

(58) Field of Classification Search
CPC ..... G03G 15/5058
USPC ..... 399/49, 44, 301
See application file for complete search history.

(56) References Cited

U.S. PATENT DOCUMENTS 5,247,462 A * 9/1993 Blasius et al. ..... B41F 33/0081 356/401
5,854,958 A * 12/1998 Tanimoto et al. . G03G 15/5058 347/116
6,275,244 B1 * 8/2001 Omelchenko et al. ..... G03G 15/0152 346/116
6,909,516 B1 * 6/2005 Hoover ..... G01D 5/347 347/116
7,616,918 B2 * 11/2009 Jeon ..... H04N 1/506 399/301
7,693,467 B2 4/2010 Kadowaki
8,718,519 B2 5/2014 Nakashima
(Continued)

FOREIGN PATENT DOCUMENTS

JP 10-282763 A 10/1998
JP 2001-356542 A 12/2001
JP 2005-257753 A 9/2005
(Continued)

*Primary Examiner* — Quana M Grainger
(74) *Attorney, Agent, or Firm* — Fitzpatrick, Cella, Harper & Scinto

(57) ABSTRACT

An image forming apparatus includes: a detection unit configured to detect a detection pattern on a first region in a first misregistration state and the detection pattern on a second region in a second pattern in a second misregistration state, and a control unit configured to perform misregistration correction by obtaining a misregistration amount in the main scanning direction based on a detection result of the detection pattern. The detection pattern has a first edge that is tilted by a first angle with respect to the main scanning direction on the first region, and has a second edge that is running in the main scanning direction or tilted by a second angle, which is smaller than the first angle, with respect to the main scanning direction on the second region.

33 Claims, 16 Drawing Sheets

(56) References Cited

U.S. PATENT DOCUMENTS

| | | | |
|---|---|---|---|
| 2014/0037343 | A1 | 2/2014 | Nakashima |
| 2014/0169842 | A1 | 6/2014 | Nakashima |

FOREIGN PATENT DOCUMENTS

| | | | |
|---|---|---|---|
| JP | 2007-264238 | A | 10/2007 |
| JP | 2009-053500 | A | 3/2009 |

* cited by examiner

IMAGE FORMING APPARATUS THAT OBTAINS MISREGISTRATION AMOUNT FROM DETECTION RESULT OF DETECTION PATTERN

BACKGROUND OF THE INVENTION

Field of the Invention

The present disclosure relates to a technique of misregistration correction in an image forming apparatus.

Description of the Related Art

One known example of an electrophotographic image forming apparatus is a so-called tandem image forming apparatus in which image forming units of different colors are provided independently. This tandem image forming apparatus adopts a configuration in which images are transferred sequentially from the image forming units of different colors to an intermediate transfer belt, and then the images are collectively transferred from the intermediate transfer belt to a recording material. In such an image forming apparatus, due to mechanical factors in the image forming units of different colors, misregistration (positional shift) could possibly occur when the images are layered. In order to correct the misregistration, in the image forming apparatus, detection patterns of different colors are formed on the intermediate transfer belt, and misregistration amounts in a main scanning direction and a sub scanning direction are obtained.

Japanese Patent Laid-Open No. 2001-356542 discloses a configuration in which a misregistration amount in the main scanning direction is obtained using a detection pattern with diagonal lines that form a certain angle with the main scanning direction. For example, a distance between two diagonal lines that together exhibit symmetry with respect to the main scanning direction, and a distance between one diagonal line and a line running in the main scanning direction, deviate from the ideal values due to misregistration in the main scanning direction. Therefore, the misregistration amount in the main scanning direction can be obtained by detecting the amount of this deviation. The length of such a detection pattern in the sub scanning direction increases in accordance with the maximum value of the estimated misregistration amount in the main scanning direction. The larger the length of the detection pattern in the sub scanning direction, the longer the time period of detection of the detection pattern. Furthermore, depending on the length of the intermediate transfer belt, detection patterns of all colors may not be placed on the intermediate transfer belt to fit within one revolution thereof.

In view of this, Japanese Patent Laid-Open No. 2009-053500 discloses a configuration in which the length of a detection pattern in the sub scanning direction is reduced with use of a detection pattern with two diagonal lines that are tilted in the same direction.

Provided that the maximum value of the misregistration amount that can be detected in the main scanning direction is the same, the length of the detection pattern disclosed in Japanese Patent Laid-Open No. 2009-053500 is two thirds, in the sub scanning direction, of the length of a detection pattern with a diagonal line that is tilted by 45 degrees with respect to the main scanning direction. However, it has been desired to further reduce the length in the sub scanning direction and detect the misregistration amount in the main scanning direction in a shorter period of time.

SUMMARY OF THE INVENTION

According to an aspect of the present invention, an image forming apparatus includes: a forming unit configured to form a detection pattern on a first region and a second region of an image carrier, a position of the second region being different from the first region in a main scanning direction; a detection unit configured to detect the detection pattern on the first region in a first misregistration state, and to detect the detection pattern on the second region in a second misregistration state, a misregistration amount of the second misregistration state being larger than that of the first misregistration state; and a control unit configured to perform misregistration correction by obtaining a misregistration amount in the main scanning direction based on a detection result of the detection pattern on the first region in case of the first misregistration state, and to perform misregistration correction by obtaining a misregistration amount in the main scanning direction based on a detection result of the detection pattern on the second region in case of the second misregistration state. The detection pattern has a first edge that is tilted by a first angle with respect to the main scanning direction on the first region, and has a second edge that is running in the main scanning direction or tilted by a second angle, which is smaller than the first angle, with respect to the main scanning direction on the second region.

Further features of the present invention will become apparent from the following description of exemplary embodiments with reference to the attached drawings.

DESCRIPTION OF THE EMBODIMENTS

The following describes exemplary embodiments of the present invention with reference to the drawings. It should be noted that the following embodiments are exemplary, and the present invention is not limited to the substances of the embodiments. In addition, the constituent elements that are not necessary for the description of the embodiments are omitted from the drawings to be referenced below.

<First Embodiment>

Figure 1:
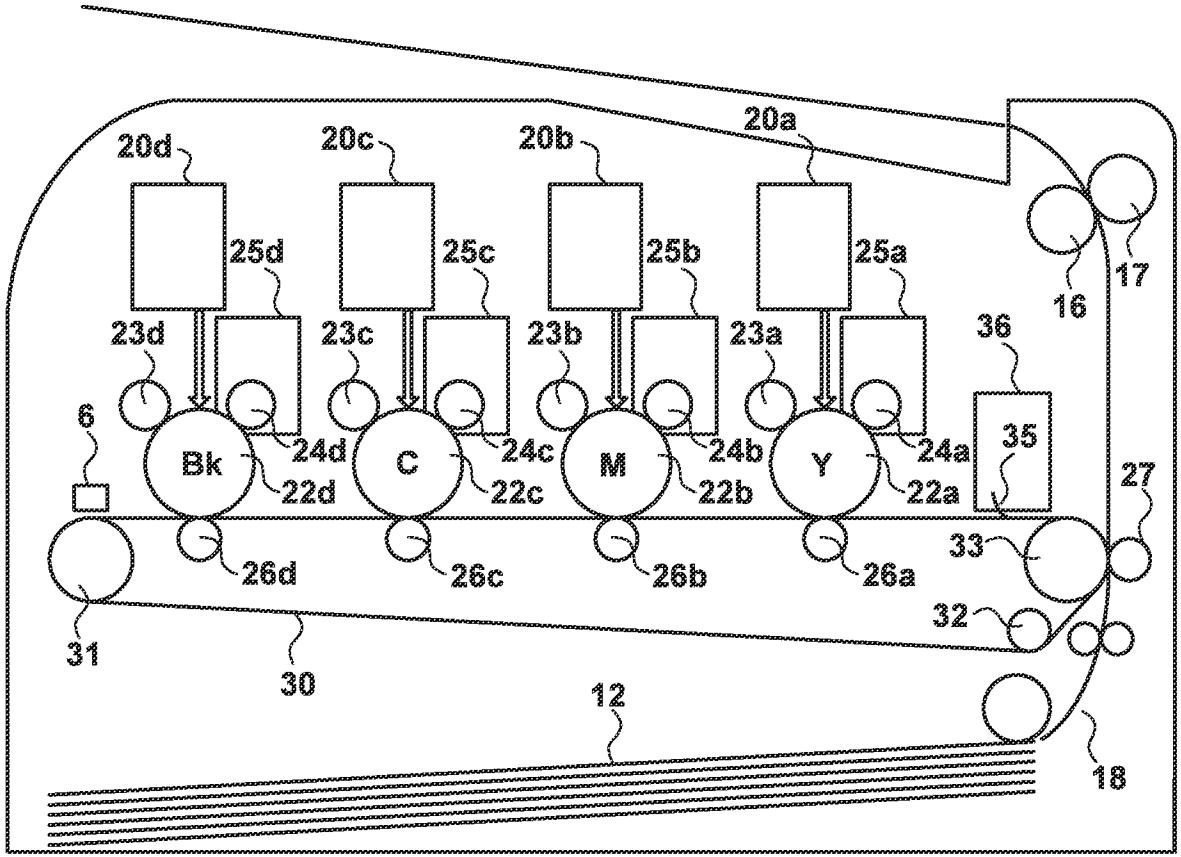
FIG. 1 is a schematic configuration diagram of an image forming apparatus according to an embodiment.

FIG. 1 is a configuration diagram of an image forming unit of an image forming apparatus according to the present embodiment. It should be noted that the alphabetical letters a, b, c, and d appended at the ends of reference signs indicate that the corresponding components are intended to form developer images in yellow (Y), magenta (M), cyan (C), and black (Bk), respectively. In addition, in the case where it is not necessary to distinguish between colors, reference signs are used without appending the alphabetical letters a, b, c, and d at the ends thereof. A photosensitive member 22 is an image carrier, and is driven to rotate. A charging roller 23 charges the surface of the corresponding photosensitive member 22 to a uniform electric potential. As one example, the charging roller 23 outputs a charging bias of −1200 V; as a result, the surface of the photosensitive member 22 is charged to an electric potential of −700 V (dark potential). An exposure unit 20 scans and exposes the surface of the photosensitive member 22 with laser light corresponding to image data of an image to be formed, thereby forming an electrostatic latent image on the photosensitive member 22. As one example, as a result of the exposure to the laser light, an area in which the electrostatic latent image is formed has an electric potential of −100 V (bright potential). A developing unit 25 has a developer of a corresponding color, and develops the electrostatic latent image on the photosensitive member 22 by supplying, using a developing sleeve 24, the developer to the electrostatic latent image formed on the photosensitive member 22. As one example, the developing sleeve 24 outputs a developing bias of −350 V, and due to this electric potential, the developing unit 25 causes the developer to attach to the electrostatic latent image. A primary transfer roller 26 performs primary transfer whereby a developer image formed on the photosensitive member 22 is transferred to an intermediate transfer belt 30, which is an image carrier and is driven by rollers 31, 32, and 33 to rotate in a loop. As one example, the primary transfer roller 26 outputs a primary transfer bias of +1000 V, and due to this electric potential, the primary transfer roller 26 transfers the developer to the intermediate transfer belt 30. At this time, a color image is formed by transferring the developer images on the photosensitive members 22 to the intermediate transfer belt 30 in an overlapped manner.

A secondary transfer roller 27 performs secondary transfer whereby the developer images on the intermediate transfer belt 30 are transferred to a recording material 12 conveyed on a conveyance path 18. A pair of fixing rollers 16 and 17 heats and fixes the developer images transferred to the recording material sheet 12. Here, the developer that has not been transferred by the secondary transfer roller 27 from the intermediate transfer belt 30 to the recording material 12 is collected by a cleaning blade 35 into a container 36. In addition, in order to perform misregistration correction control, a detection sensor 6 is provided so as to oppose the intermediate transfer belt 30.

It should be noted that the exposure unit 20 may be embodied so as to expose the photosensitive member 22 with light using an LED array and the like instead of a laser. In addition, the image forming apparatus may be configured such that, instead of being provided with the intermediate transfer belt 30, it includes a recording material conveyance belt used in transferring the developer images on the photosensitive members 22 directly to the recording material 12.

Figure 2:
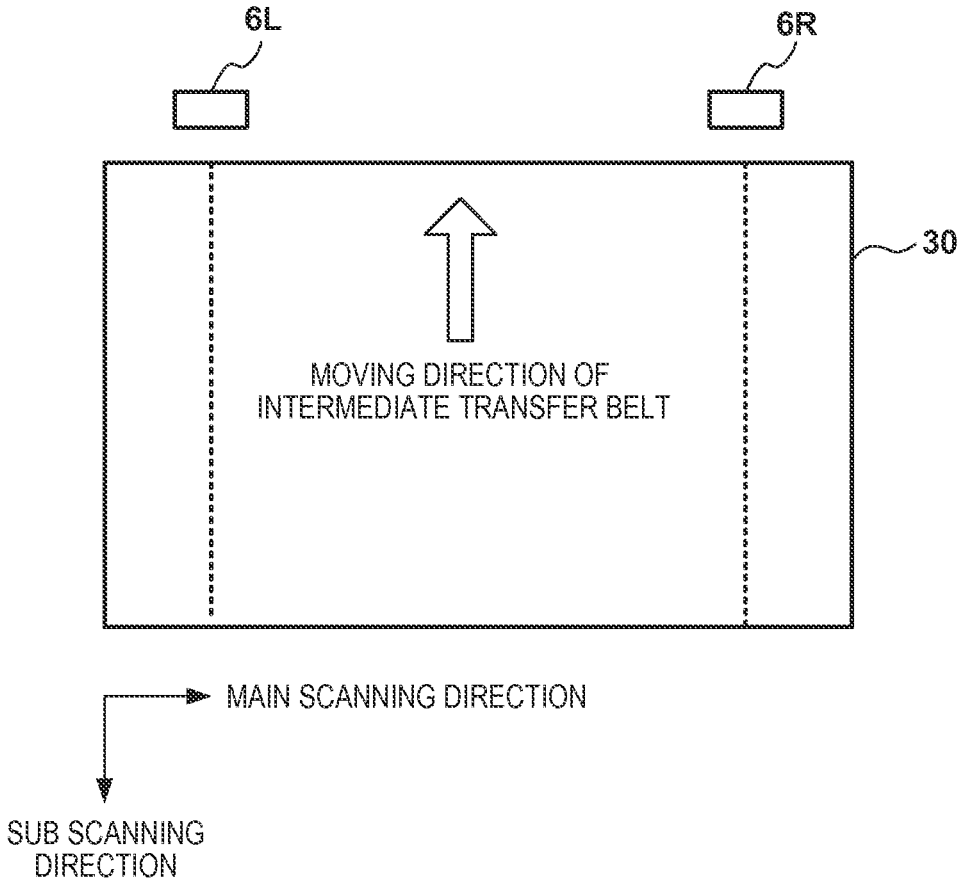
FIG. 2 shows the placements of detection sensors according to an embodiment.

In the present embodiment, as shown in FIG. 2, the detection sensor 6 includes two detection sensors 6L and 6R that are placed along a main scanning direction. The detection sensor 6L is placed in a position corresponding to the vicinity of a position in which the formation of the electrostatic latent image on the photosensitive member 22 is started, whereas the detection sensor 6R is placed in a position corresponding to the vicinity of a position in which the formation of the electrostatic latent image on the photosensitive member 22 is ended. The detection sensors 6L and 6R each include a light emitting element, such as an LED, and a light receiving element, such as a phototransistor. Light from the light emitting element is reflected by the surface of the intermediate transfer belt 30 and/or by a detection pattern formed on the surface of the intermediate transfer belt 30; the light receiving element receives this reflected light, and outputs a signal indicating the amount of received light. It should be noted that, while the light receiving element receives specular reflection light from the surface of the intermediate transfer belt 30 and/or from the detection pattern formed on that surface in the present embodiment, the light receiving element may receive diffuse reflection light. In addition, two light receiving elements that receive specular reflection light and diffuse reflection light may be included.

Figure 3:
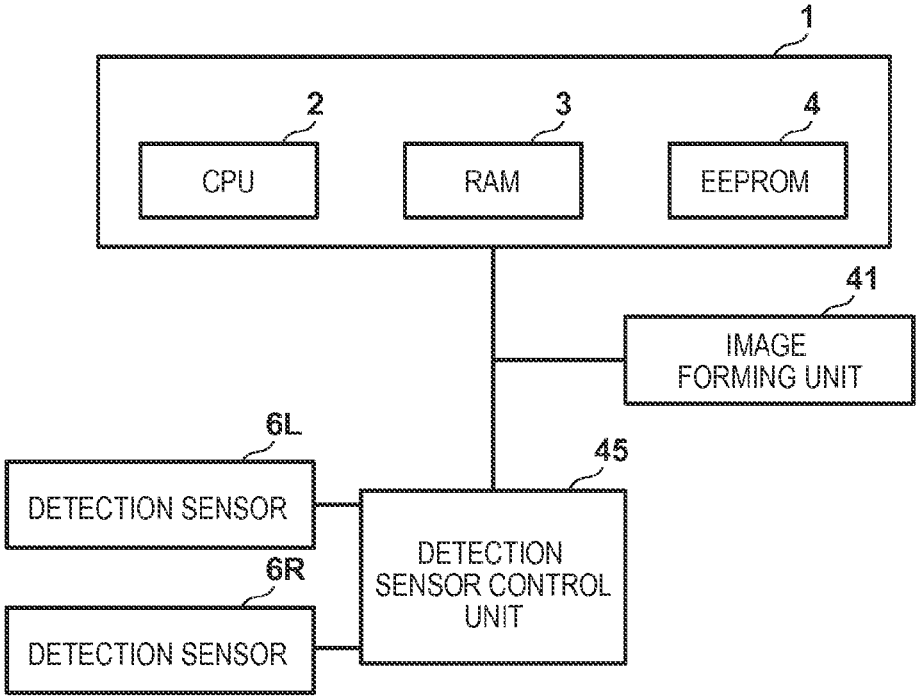
FIG. 3 is a control configuration diagram of an image forming apparatus according to an embodiment.

FIG. 3 shows a control configuration related to the misregistration correction according to the present embodiment. A control unit 1 integrally controls the operations of the misregistration correction control. Using a RAM 3 as a main memory and a working area, a CPU 2 controls the functional blocks in accordance with various types of data stored in an EEPROM 4 in relation to the misregistration correction operations. In the misregistration correction control, an image forming unit 41 forms a detection pattern on the intermediate transfer belt 30 by controlling the components of FIG. 1 based on image data stored in the EEPROM 4 showing the detection pattern. It should be noted that, in the present embodiment, the detection pattern is formed at both sides of the intermediate transfer belt 30, that is to say, in positions that can be detected by the detection sensors 6L and 6R. The detection sensors 6L and 6R output a signal corresponding to the amount of reflected light to a detection sensor control unit 45. The detection sensor control unit 45 makes a determination about the signal corresponding to the amount of reflected light with reference to a threshold, and outputs detection timings of edges of the detection pattern to the control unit 1. The control unit 1 obtains a misregistration amount from the detection timings of the edges of the detection pattern. The obtained misregistration amount is stored into the EEPROM 4.

Figure 4:
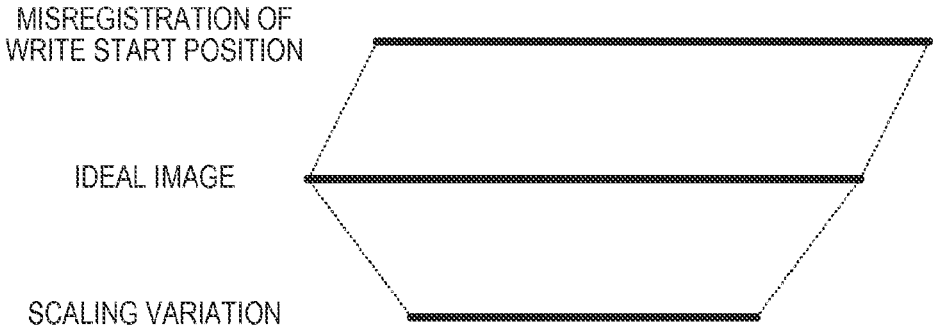
FIG. 4 is a diagram for describing misregistration in the main scanning direction.

Below, a description will be given only of the misregistration correction in the main scanning direction, which is the target of the present embodiment, and a description of the misregistration correction in a sub scanning direction will be omitted. It is therefore assumed that the misregistration amount and the misregistration correction mentioned in the following description are of the main scanning direction, unless specifically stated otherwise. As shown in FIG. 4, misregistration in the main scanning direction occurs as a result of misregistration of a write start position, which is misregistration of a start position in the main scanning direction with respect to an ideal image, and scaling variation where the length in the main scanning direction changes from the ideal image. Here, misregistration of the write start position occurs due to, for example, a change in a relative positional relationship between the exposure unit 20 and the photosensitive member 22. On the other hand, scaling variation occurs due to, for example, a change in the distance between the exposure unit 20 and the photosensitive member 22.

Figure 5:
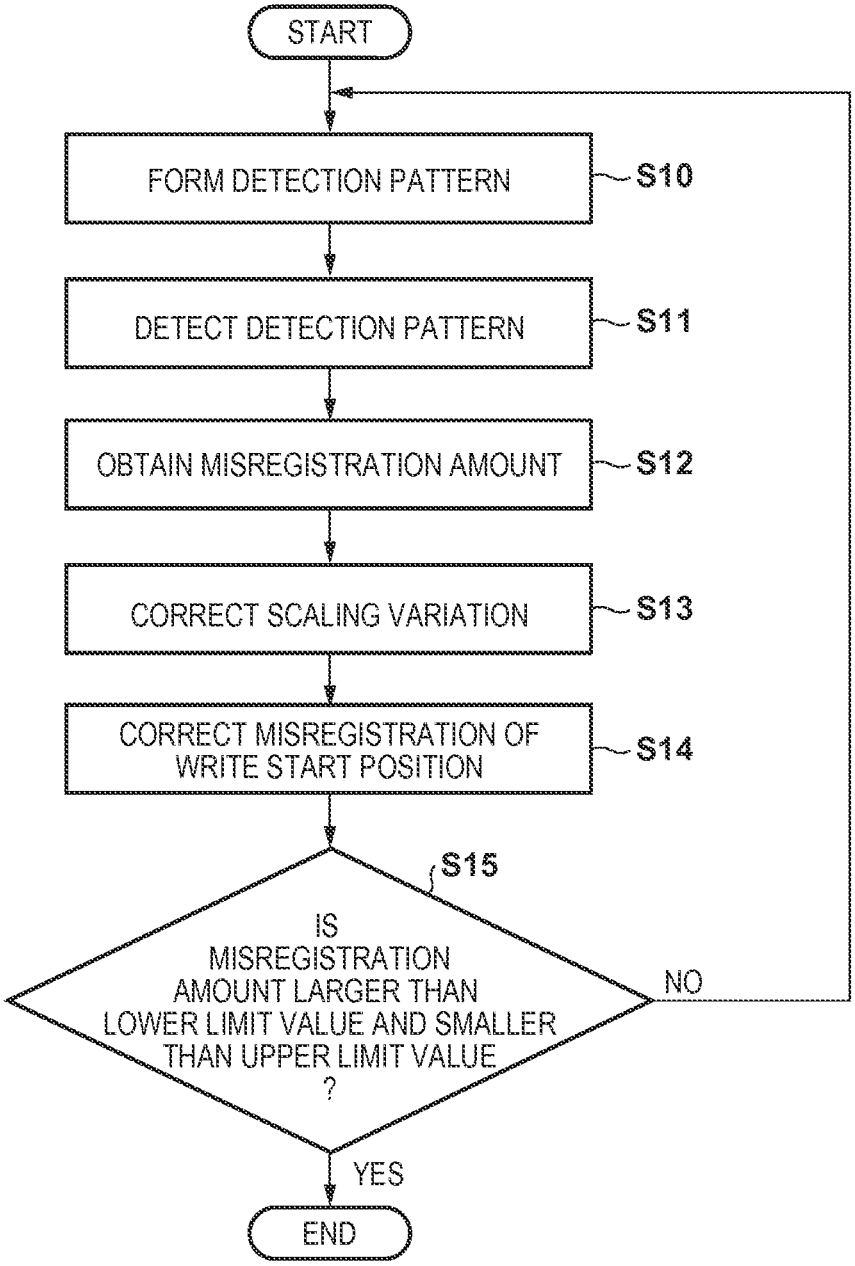
FIG. 5 is a flowchart of misregistration correction control according to an embodiment.

The following describes the misregistration correction control according to the present embodiment. It should be noted that the misregistration correction control described below is performed on a color-by-color basis. FIG. 5 is a flowchart of the misregistration correction control according to the present embodiment. Upon the start of the misregistration correction, the control unit 1 causes the image forming unit 41 to form a detection pattern on the intermediate transfer belt 30 in step S10. It should be noted that the misregistration correction control is performed when a predetermined condition is satisfied, such as when the power is turned on and when the temperature inside the image forming apparatus has fluctuated by a predetermined value or more due to continuous printing and the like.

Figure 6:
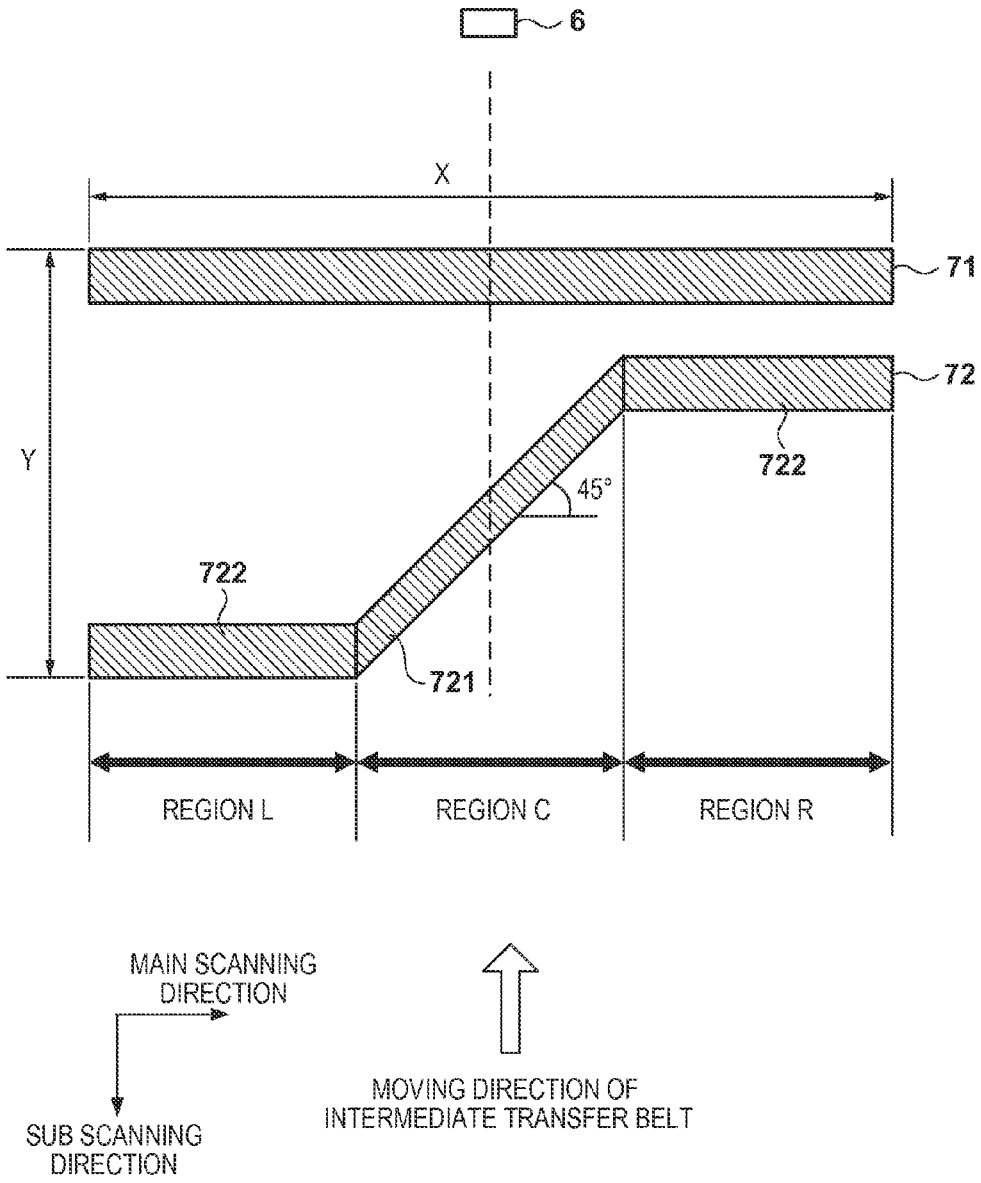
FIG. 6 shows a detection pattern according to an embodiment.

FIG. 6 shows the detection pattern according to the present embodiment. The detection pattern includes a reference image 71 and a detection image 72. The reference image 71 is a line-shaped image running in the direction orthogonal to the moving direction of the intermediate transfer belt 30. In other words, the reference image 71 is a line-shaped image running in the main scanning direction. The reference image 71 has two edges running in the main scanning direction. The detection image 72 includes a line-shaped first image 721, which forms an angle of 45 degrees with the main scanning direction, and line-shaped second images 722 that are positioned at both sides of the first image 721 and parallel to the reference image 71. Below, a region in which the first image 721 is formed is referred to as a region C, whereas regions at both sides of the region C, that is to say, regions in which the second images 722 are formed are referred to as regions L and R. In FIG. 6, the second images 722 are connected to the first image 721 at region boundaries. However, the second images 722 may not be connected to the first image 721 at the region boundaries if the distances between the reference image 71 and the second images 722 in the sub scanning direction are equal to or larger than the maximum value of the distance between the reference image 71 and the first image 721 in the sub scanning direction, or are equal to or smaller than the minimum value of that distance.

It should be noted that, in the example of FIG. 6, the regions L, C, and R all have a length of 50 dots in the main scanning direction. Also, the length of the second images 722 in the sub scanning direction, the length of the reference image 71 in the sub scanning direction, and the interval between the reference image 71 and the detection image 72 in the region R are all 10 dots, so as to enable reliable detection of the reference image 71 and the detection image 72. Therefore, the detection pattern according to the present embodiment has a length X of 150 dots in the main scanning direction, and a length Y of 80 dots in the sub scanning direction. For example, in the case of 600 dpi, the length X is approximately 6.4 mm, and the length Y is approximately 3.4 mm. A dash line of FIG. 6 indicates a detection position of the detection sensor 6. That is to say, the detection sensor 6 detects the detection pattern along the dash line of FIG. 6. It should be noted that, in FIG. 6 and similar figures used in the following description, the detection sensor 6 collectively refers to the detection sensors 6L and 6R.

Figure 7:
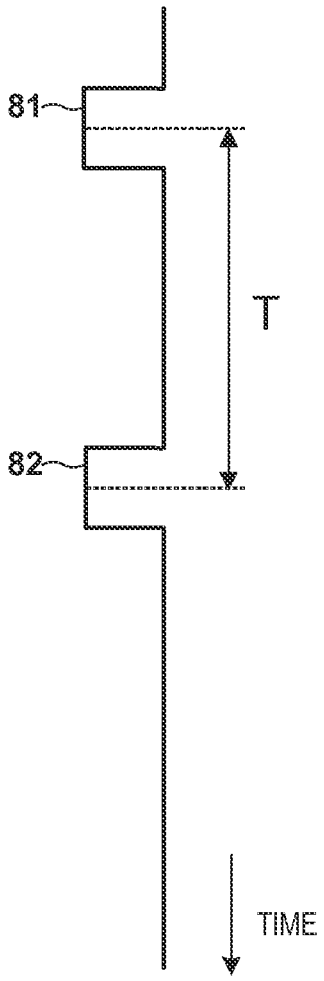
FIG. 7 is a diagram for describing a method for detecting a detection pattern according to an embodiment.

Returning to FIG. 5, in step S11, the detection sensor control unit 45 detects the edges of the detection pattern from the output of the detection sensor 6. FIG. 7 shows a simplified form of a signal output from the detection sensor 6 when the detection pattern passes a detection region of the detection sensor 6 with the movement of the intermediate transfer belt 30. When an image of the detection pattern enters the detection region of the detection sensor 6, the specular reflection light is reduced, and hence the output of the detection sensor 6 becomes smaller than when the image of the detection pattern is outside the detection region. In FIG. 7, the decrease in the output indicated by the reference sign 81 is attributed to the reference image 71, whereas the decrease in the output indicated by the reference sign 82 is attributed to the detection image 72. For example, the control unit 1 uses the center between the first fall and rise as the detection time of the reference image 71, the center between the next fall and rise as the detection time of the detection image 72, and the difference between these detection times as a detection value T. It should be noted that one of the fall and rise of the signal, that is to say, the detection time of an edge may also be used as the detection time of the reference image 71 or the detection image 72. In addition, the actual output of the detection sensor 6 does not change rapidly as shown in FIG. 7, but rather gradually decreases as the image of the detection pattern enters the detection region of the detection sensor 6 and gradually increases as the image of the detection pattern leaves the detection region of the detection sensor 6. However, the detection sensor control unit 45 obtains a signal waveform shown in FIG. 7 by binarizing the output of the detection sensor 6 through comparison with a threshold using a comparator. The control unit 1 stores the detection value T into the RAM 3.

Returning to FIG. 5, in step S12, the control unit 1 obtains a misregistration amount xR from the detection value T from the detection sensor 6R, and obtains a misregistration amount xL from the detection value T from the detection sensor 6L. It should be noted that, in the following description, the misregistration amounts xL and xR are collectively noted as the misregistration amount x. For example, as the first image 721 in the region C is tilted by 45 degrees with respect to the main scanning direction, provided that the detection value and the moving speed of the intermediate transfer belt 30 when the detection pattern is in the ideal position are T0 and Vp, respectively, the misregistration amount (distance) x can be obtained by $x=(T-T0)\times Vp$. If the detection pattern of FIG. 6 is shifted to rightward from the ideal position, the detection value T increases, and the value of (T−T0) becomes positive. On the other hand, if the detection pattern is shifted to leftward from the ideal position, the detection value T decreases, and the value of (T−T0) becomes negative. That is to say, the direction of misregistration of the detection pattern with respect to the ideal position can be distinguished from positivity and negativity of the misregistration amount x, and the misregistration amount thereof can be distinguished from the absolute value of the misregistration amount x.

Figure 8:
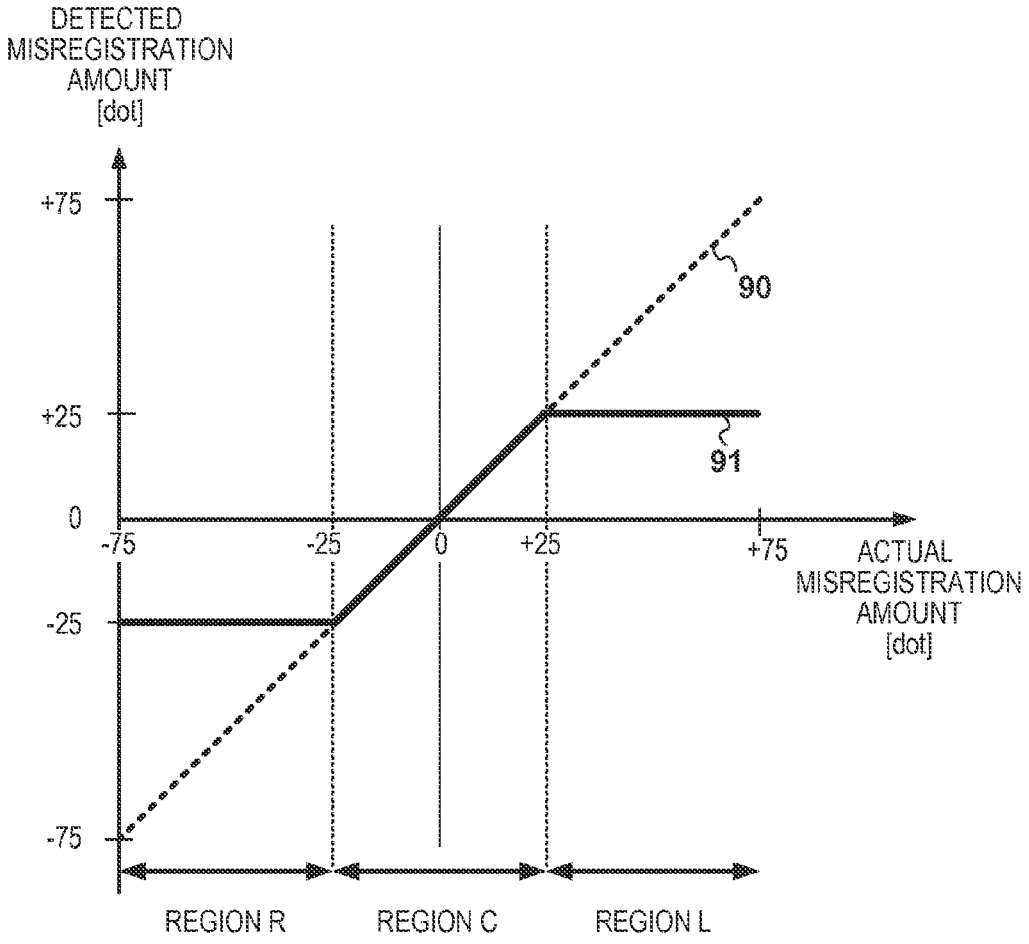
FIG. 8 shows a relationship between an actual misregistration amount and a detected misregistration amount according to an embodiment.

A line indicated by the reference sign 91 in FIG. 8 represents a relationship between the actual misregistration amount of the detection pattern with respect to the ideal position and the detected misregistration amount x of the detection pattern. It is assumed that the detection sensor 6 detects the center of the region C in the main scanning direction when the detection pattern is in the ideal position, and the distance is expressed by the number of dots in FIG. 8. As the region C of FIG. 6 has a length of 50 dots, the misregistration amount can be detected accurately if the actual misregistration in the main scanning direction is in a range of −25 dots to 25 dots. However, if the absolute value of the actual misregistration amount is larger than 25 dots, a misregistration amount of −25 dots or 25 dots is detected at any time, depending on positivity and negativity of the actual misregistration amount. That is to say, if the region R and the region L are in the detection region of the detection sensor 6 as a result of misregistration, a misregistration amount x of −25 dots or +25 dots is detected, regardless of the actual misregistration amount. It should be noted that the reference sign 90 of FIG. 8 represents a relationship between the actual misregistration amount and the detected misregistration amount x in the case where the regions L and R are not provided and the detection image 72 is composed only of a tilted image. By using such a detection image 72 composed only of a tilted image, the misregistration amount can be detected accurately even if the absolute value of the actual misregistration amount is larger than 25 dots; however, in this case, the length Y required for the detection pattern in the sub scanning direction is 180 dots. That is to say, the length required in this case is equal to or larger than twice the 80-dot length Y of the detection pattern of FIG. 6.

Returning to FIG. 5, in step S13, the control unit 1 obtains a value of scaling variation from the misregistration amounts xL and xR, and corrects the scaling variation. It should be noted that the scaling variation value xw is xR−xL, which is the variation amount with respect to the ideal length in the main scanning direction. The control unit 1 performs control to make the length in the main scanning direction match the ideal length by correcting a clock for image formation based on the scaling variation value xw. Subsequently, in step S14, the control unit 1 calculates a misregistration amount of the write start position from the misregistration amounts xL and xR, and corrects the misregistration of the write start position. It should be noted that the misregistration amount xtop of the write start position is obtained by (xL+xR)/2. This is an average value of the two misregistration values xL and xR.

As has been described with reference to FIG. 8, if the detection sensor 6 is detecting the region R or the region L, the misregistration amount x detected in step S12 of FIG. 5 has an upper limit value or a lower limit value. For example, in FIG. 8, the upper limit value is +25 dots and the lower limit value is −25 dots. Therefore, if the misregistration amount x detected in step S12 has this lower limit value or upper limit value, there is a high possibility that the corrections performed in steps S13 and S14 are not based on the actual misregistration amount, and therefore there is a high possibility that the misregistration has not been corrected accurately. Therefore, in step S15, the control unit 1 determines whether the misregistration amount is smaller than the upper limit value and larger than the lower limit value, and if it determines that the misregistration amount is smaller than the upper limit value and larger than the lower limit value, it ends the processing assuming that the misregistration has been corrected accurately. On the other hand, if the misregistration amount has the lower limit value or the upper limit value, there is a high possibility that sufficient correction has not been performed, and therefore the processes from step S10 are executed again.

For example, assume the case in which the overall scaling variation is 0 and the misregistration amount of the write start position is +60 dots. In this case, the actual misregistration amounts xL and xR are both +60 dots. However, when the detection pattern of FIG. 6 is used, the misregistration amounts xL and xR detected by the control unit 1 are both +25 dots, and therefore the write start position is corrected by 25 dots in the first write start position correction. This leaves +35 dots as the actual misregistration amount of the write start position. In the second step S12, the control unit 1 detects +25 dots as the misregistration amounts xL and xR, thereby leaving +10 dots as the misregistration amount of the write start position after the second correction. Therefore, in the third step S12, the control unit 1 detects +10 dots as the misregistration amounts xL and xR, and correction is completed by the third write start position correction.

As described above, the misregistration amount is obtained from the detection result of the detection pattern. In addition, whether the region being detected is the region C or the region L or R is determined based on the misregistration amount. In other words, whether the region being detected is the region C or the region L or R is determined from the detection timing of the detection image with respect to the reference image. In the case where the region C is being detected, the actual misregistration amount is obtained, and therefore the control unit 1 performs the misregistration correction based on the obtained misregistration amount. On the other hand, in the case where the region L or R is being detected, the actual misregistration amount is larger than the obtained misregistration amount. Therefore, the misregistration that has actually occurred is corrected by performing the misregistration correction using the obtained positional misregistration amount, re-forming the detection pattern, and re-performing the misregistration correction, in this order. It should be noted that, in the present embodiment, whether the region L or R is being detected is determined from the detected misregistration amount, and if the region L or R is being detected, the correction is performed using the detected misregistration amount. However, in the present embodiment, if the region L or R is being detected, the correction may be performed using a predetermined misregistration amount instead of the detected misregistration amount. For example, the following configuration may be adopted: in the example of FIG. 6, if a misregistration amount of 25 dots is detected, the misregistration is corrected by 30 dots.

By using the detection pattern according to the present embodiment, the length of the detection pattern in the sub scanning direction can be reduced. For instance, in the example of FIG. 6, the 80-dot length Y of the detection pattern in the sub scanning direction is approximately 44% of the 180-dot length Y of a detection pattern corresponding to the reference sign 90 in FIG. 8 in the sub scanning direction. It should be noted that these values are true of one color; for all of the colors used in image formation, a length of 400 dots can be reduced. Furthermore, in the actual misregistration correction, in order to offset the speed fluctuation during one rotation cycle of the photosensitive member 22, the detection pattern is formed multiple times on a color-by-color basis. Therefore, the length that can be reduced increases in accordance with the number of times the detection pattern is formed.

With the detection pattern according to the present embodiment, if the absolute value of the misregistration amount that has actually been produced is equal to or larger than a predetermined value, the formation of the detection pattern and the misregistration correction need to be repeated multiple times. However, relatively large misregistration occurs at the time of manufacturing and replacement of components, and the frequency of occurrence thereof is not so high. Therefore, the settings are configured such that the misregistration amount produced in normal use of the image forming apparatus falls in the range of the misregistration amount that can be detected in single processing, and large misregistration that could possibly occur at the time of manufacturing and replacement of components does not fall in that range. In this way, the length of the detection pattern in the sub scanning direction can be reduced while lowering the frequency of occurrence of the situation in which the formation and correction of the detection pattern are repeated multiple times. In the present embodiment, in order to detect large misregistration in the main scanning direction, it is sufficient to increase the length of the regions L and R of FIG. 6, that is to say, it is only necessary to increase their size in the main scanning direction, and it is not necessary to increase their size in the sub scanning direction.

While the determination of step S15 in FIG. 5, which may result in the repetition, is made by comparison with the upper limit value and the lower limit value of the detectable range, one or both of the upper limit value and the lower limit value may have a margin for narrowing the detectable range. For example, in the case where the lower limit value and the upper limit value are −25 dots and +25 dots, respectively, whether or not to carry out the repetition can be determined by comparing the misregistration amount with −23 dots and +23 dots.

Figure 9:
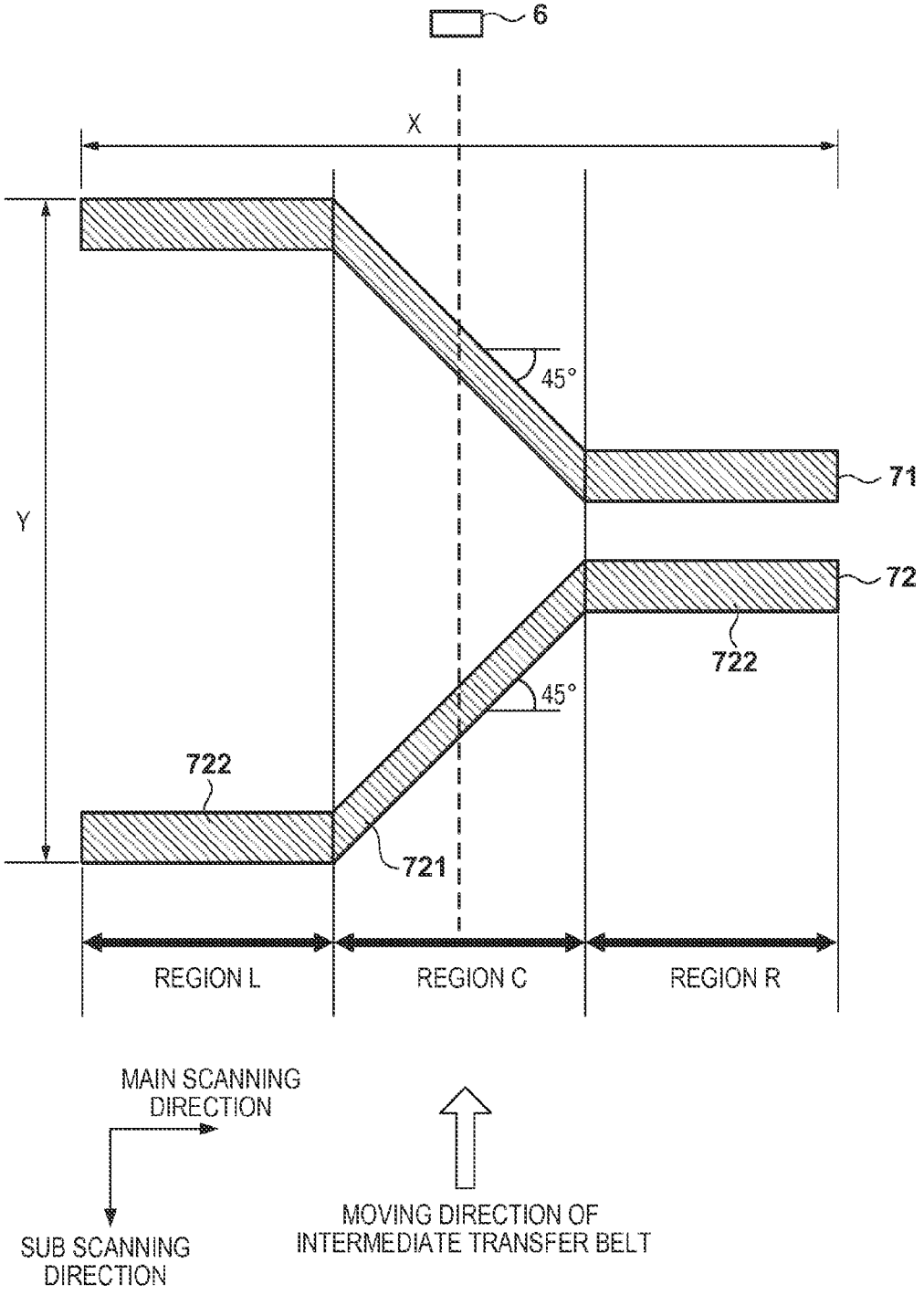
FIG. 9 shows a detection pattern according to an embodiment.

In addition, while the detection pattern of FIG. 6 has a tilt of 45 degrees with respect to the main scanning direction in the region C, the angle of tilt may have other values. Furthermore, while the detection pattern of FIG. 6 has the regions L and R at both sides of the region C, in the case where misregistration occurs in the same direction, it is possible to adopt the configuration in which only one of the region L and the region R is provided. Moreover, in the detection pattern of FIG. 6, the reference image 71 lies on a straight line parallel to the main scanning direction. However, it is sufficient that the distance between the reference image 71 and the first image 721 in the sub scanning direction changes in accordance with a position in the main scanning direction, and that the distances between the reference image 71 and the second images 722 in the sub scanning direction have a predetermined value regardless of a position in the main scanning direction. It should be noted that this predetermined value is equal to or larger than the maximum value of the distance between the reference image 71 and the first image 721 in the sub scanning direction or is equal to or smaller than the minimum value of that distance. In addition, in the case where the two regions R and L are provided at both sides of the region C, the distance between the reference image 71 and the second image 722 in the sub scanning direction in the region L and the distance between the reference image 71 and the second image 722 in the sub scanning direction in the region R are set to be different from each other. In this way, the control unit 1 can determine the region being detected, and in the case where the region R and the region L are being detected, it can determine that the correction using the detected misregistration amount is not sufficient and repeat the misregistration correction until the region C is detected. Therefore, as shown in FIG. 9, the reference image 71 and the detection image 72 that together exhibit line symmetry with respect to a line running in the main scanning direction can be used.

In the detection pattern of FIG. 6, the first image 721 is connected to the second images 722, and the second images 722 are parallel to the main scanning direction. However, the second images 722 may be tilted in the same direction as the first image 721, with respect to the main scanning direction, by an angle smaller than the angle of tilt of the first image 721. The length of the detection pattern in the sub scanning direction can be reduced also when the second images 722 are tilted by an angle smaller than the angle of tilt of the first image 721. In addition, the second images 722 may not be connected to the first image 721. For example, the second image 722 in the region R of FIG. 6 may be formed in the position shifted from an end portion of the first image 721 closer to the reference image 71 toward the reference image 71 side. The same goes for the second image 722 in the region L. That is to say, it is sufficient to form the second images 722 in a range that includes one or both of an end portion of the first image 721 in the sub scanning direction and the position other than the position of the first image 721 in the sub scanning direction. This configuration makes it possible to determine a detected region from the misregistration amount that has been obtained under the assumption that the first image 721 has been detected. It should be noted that, instead of determining the detected region from the misregistration amount, the detected region may be determined simply from two detected edges or the difference between the detection timings of two images.

Figure 10:
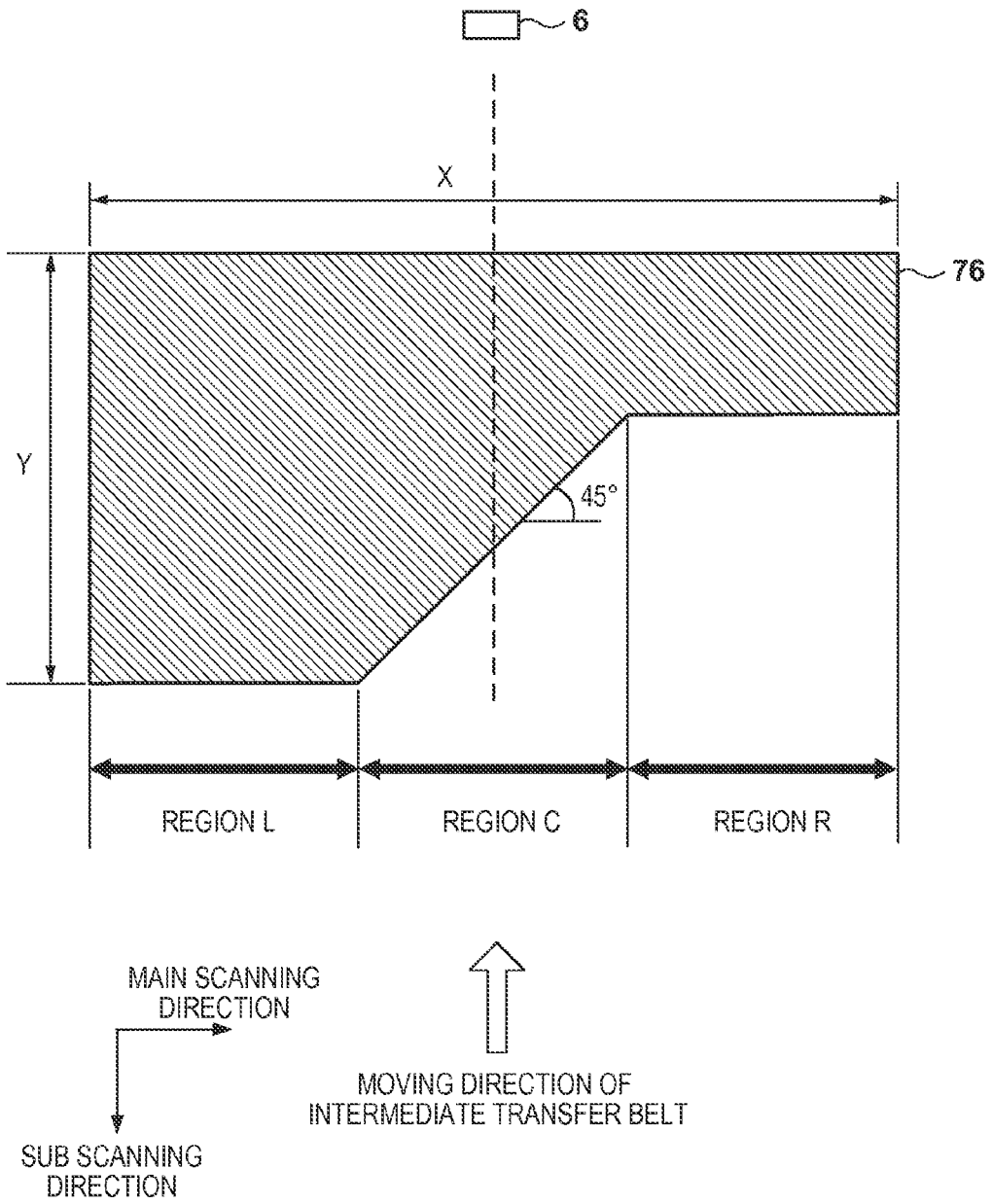
FIG. 10 shows a detection pattern according to an embodiment.

Furthermore, as shown in FIG. 10, only one detection image 76 may be used that is obtained by applying the developer entirely between the reference image 71 and the detection image 72 of FIG. 6. With the detection pattern of FIG. 10, the misregistration amount can be obtained by comparing a time period between detection of a downstream edge of the detection image 76 and detection of an upstream edge thereof in the moving direction of the intermediate transfer belt 30 with a reference value. Also, a detection pattern may be used that is obtained by applying the developer only to a peripheral portion of the detection image of FIG. 10. In addition, while the reference image is provided downstream relative to the detection image in the moving direction of the intermediate transfer belt 30 in the above-described examples, it is possible to adopt the configuration in which the reference image is provided upstream relative to the detection image.

<Second Embodiment>

Figure 11:
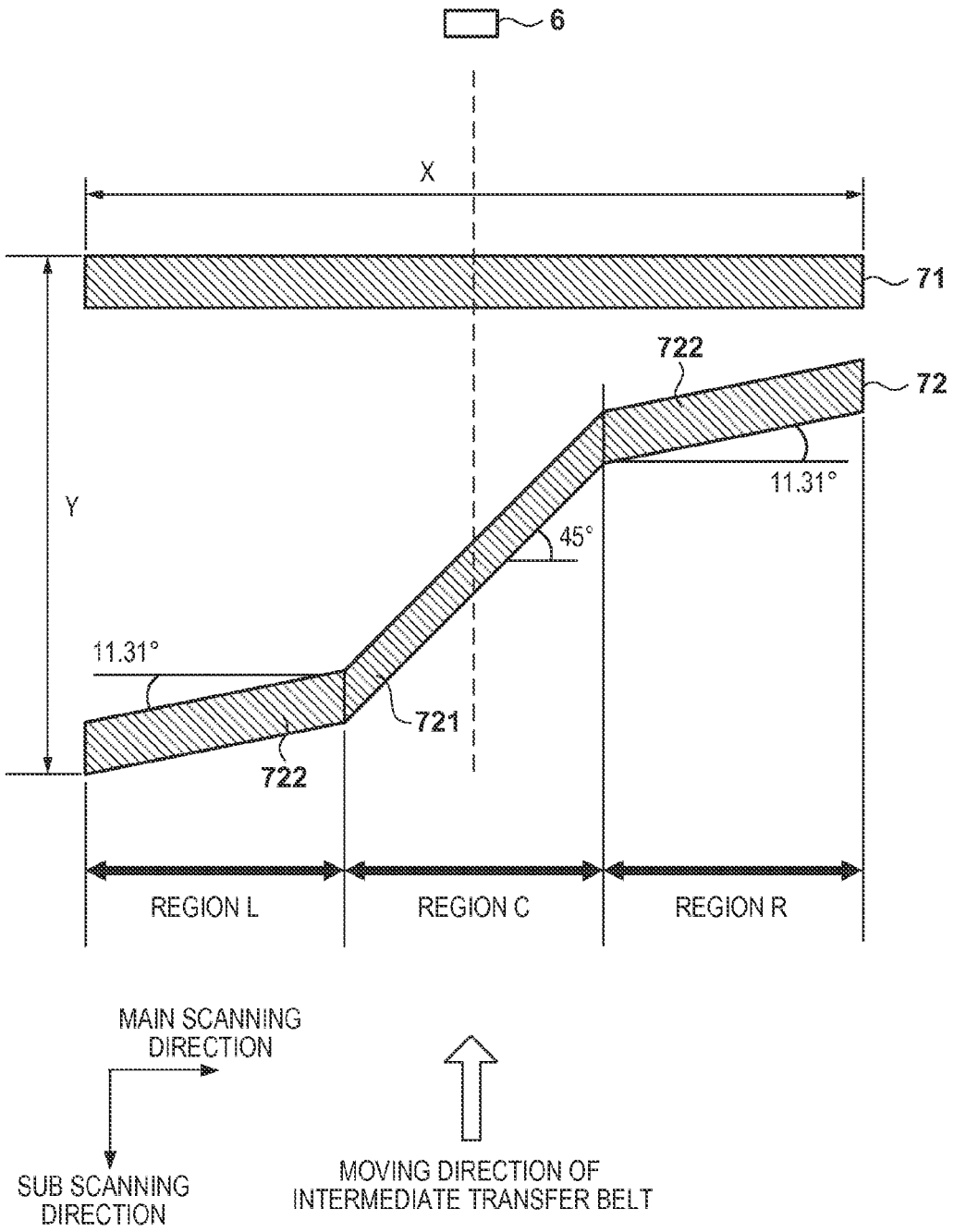
FIG. 11 shows a detection pattern according to an embodiment.

The following describes a second embodiment with a focus on differences from the first embodiment. In the first embodiment, when the region L and the region R of FIG. 6 are in the detection position of the detection sensor 6 due to a large misregistration amount in the main scanning direction, the detected misregistration amount has the upper limit value or the lower limit value of the detectable range, in which case the processing of FIG. 5 is repeated. In the present embodiment, unlike the detection pattern of FIG. 6, the second images 722 in the region L and the region R are also tilted with respect to the main scanning direction as shown in FIG. 11. With this configuration, the misregistration amount x can be obtained even if the region L and the region R are in the position of the detection sensor 6. It should be noted that the angle of tilt of the second images 722 with respect to the main scanning direction is set to be smaller than the angle of tilt of the first image 721 with respect to the main scanning direction. In this way, the repetition of the processing in the first embodiment can be avoided while reducing the length in the sub scanning direction.

Figure 12:
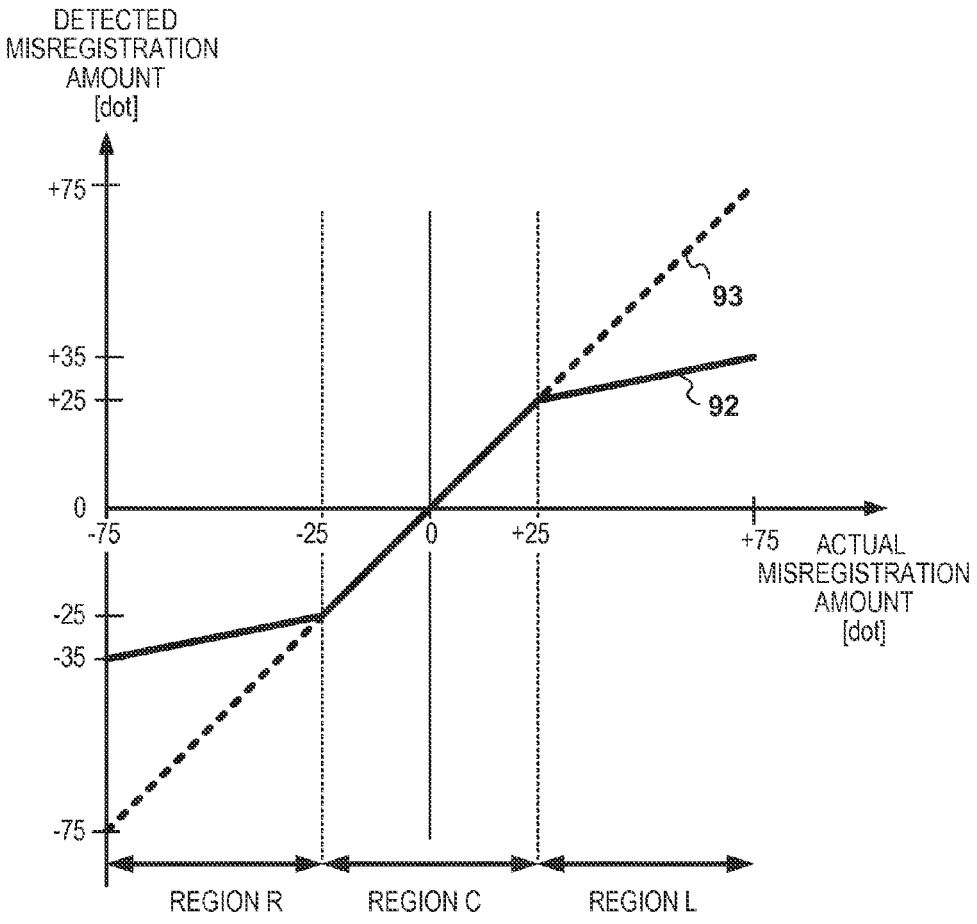
FIG. 12 shows a relationship between an actual misregistration amount and a detected misregistration amount according to an embodiment.

FIG. 12 is a diagram for describing the calculation of the misregistration amount x according to the present embodiment. A solid line 92 represents a relationship between the actual misregistration amount and the detected misregistration amount x by the control unit 1. On the other hand, a dash line 93 indicates the actual misregistration amount and the misregistration amount that should be detected by the control unit 1. In the case where the absolute value of the detected misregistration amount x is larger than 25 dots, which is the maximum absolute value of the misregistration amount that can be detected in the region C, the control unit 1 determines that the region L or the region R has been detected. In this case, the actual misregistration amount is obtained from the detected misregistration amount x indicated by the solid line 92 based on the angle with respect to the main scanning direction in the region R and the region L. More specifically, if it is determined that the region R and the region L have been detected, the actual misregistration amount is obtained from the difference between the detection timings of the reference image 71 and the detection image 72, the positions of the first image 721 and the second images 722 in the main scanning direction, and the tilts of the first image 721 and the second images 722 with respect to the main scanning direction.

<Third Embodiment>

The present embodiment will now be described with a focus on differences from the second embodiment. Unlike the first embodiment, the second embodiment enables detection of the actual misregistration amount even if the region L and the region R are in the detection region of the detection sensor 6 due to a large actual misregistration amount. To this end, however, the size of the detection pattern is larger than the size of the detection pattern according to the first embodiment in the sub scanning direction. In the present embodiment, the length of the detection pattern in the sub scanning direction is reduced compared to the second embodiment.

Figure 13:
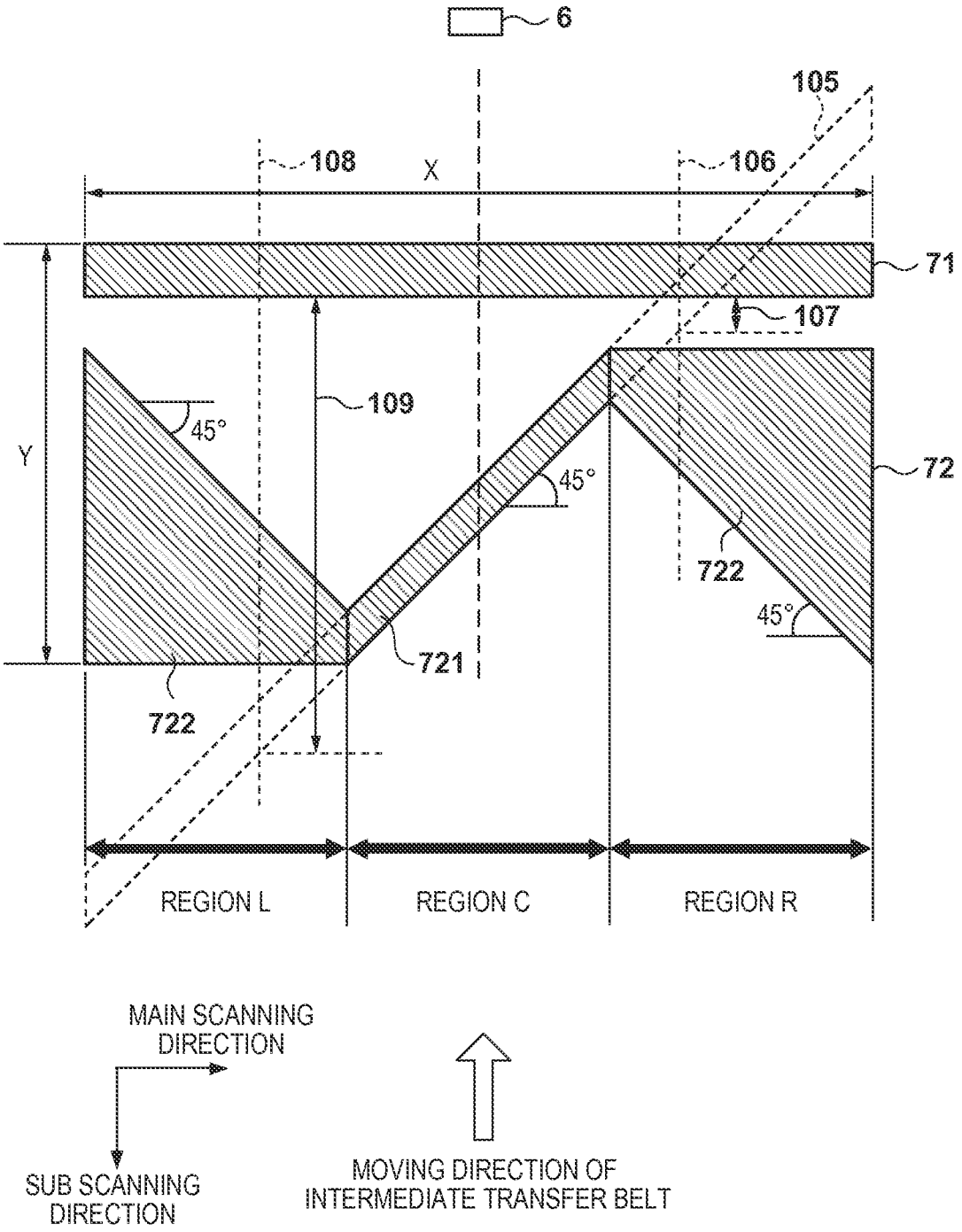
FIG. 13 shows a detection pattern according to an embodiment.

FIG. 13 shows the detection pattern according to the present embodiment. The first image 721 of the detection pattern according to the present embodiment is the same as in the first embodiment. That is to say, the first image 721 has two edges that are tilted with respect to the main scanning direction. On the other hand, the second images 722 in the regions L and R have a trapezoidal shape unlike the first embodiment. It should be noted that the second images 722 may have a triangular shape. Specifically, the second image 722 in the region L has an edge running in the main scanning direction on the upstream side in the conveyance direction of the intermediate transfer belt 30 (hereinafter simply referred to as the upstream side), and an edge that is tilted with respect to the main scanning direction on the downstream side in the conveyance direction (hereinafter simply referred to as the downstream side). On the other hand, the second image 722 in the region R has an edge running in the main scanning direction on the downstream side, and an edge that is tilted with respect to the main scanning direction on the upstream side. It should be noted that the two edges of the first image 721 are tilted so as to proceed downstream toward the right side (positive side) along the main scanning direction. On the other hand, the downstream edge of the second image 722 in the region L and the upstream edge of the second image 722 in the region R proceed upstream toward the right side (positive side) along the main scanning direction. That is to say, the direction of tilt of the two edges of the first image 721 is the reverse of the direction of tilt of the tilted edges of the second images 722.

As is apparent from FIG. 13, the length of the detection pattern according to the present embodiment is the same as the length of the detection pattern according to the first embodiment in the sub scanning direction. This is because the direction of tilt of the tilted edges of the second images 722 is reversed from the direction of tilt of the two edges of the first image 721. For the sake of reference, FIG. 13 shows the reference sign 105 representing a detection image that is tilted by 45 degrees with respect to the main scanning direction in the regions L, C, and R.

Figure 14A:
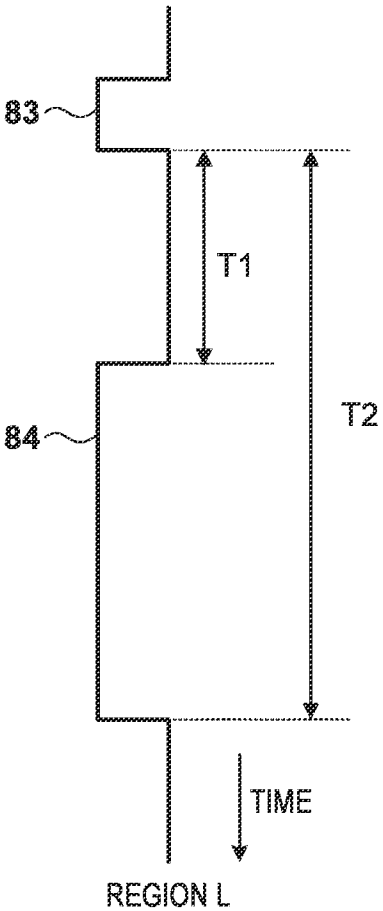
FIGS. 14A to 14C are diagrams for describing the determination of a region according to an embodiment.
Figure 14B:
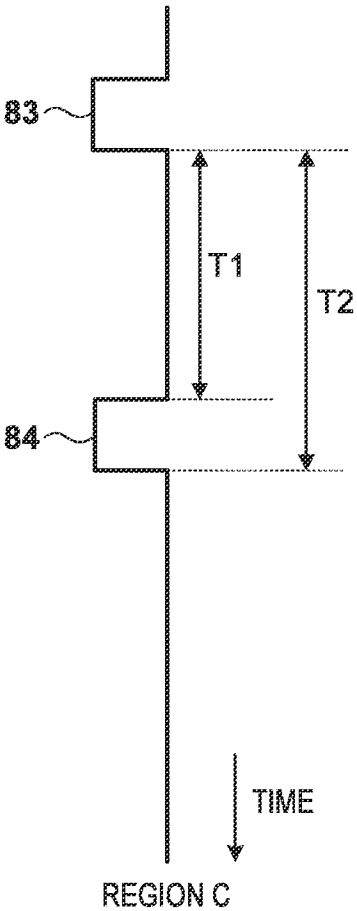
Figure 14C:
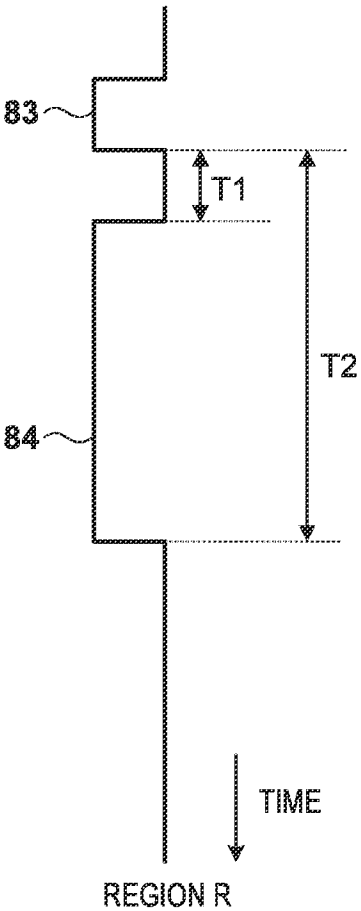

FIGS. 14A, 14B, and 14C respectively show the signal that is output from the detection sensor 6 in the case where the regions L, C, and R are in the detection region of the detection sensor 6. In FIGS. 14A to 14C, the decrease in the output indicated by the reference sign 83 is attributed to the reference image 71, whereas the decrease in the output indicated by the reference sign 84 is attributed to the detection image 72. A time period T2 is time between detection of the upstream edge of the reference image 71 and detection of the upstream edge of the detection image 72; the time period T2 has a predetermined maximum value when the region L is in the detection region of the detection sensor 6. On the other hand, a time period T1 is time between detection of the upstream edge of the reference image 71 and detection of the downstream edge of the detection image 72; the time period T1 has a predetermined minimum value when the region R is in the detection region of the detection sensor 6. Therefore, the control unit 1 can determine that the region L is being detected in the case where the time period T2 has the predetermined maximum value, determine that the region R is being detected in the case where the time period T1 has the predetermined minimum value, and determine that the region C is being detected in the case other than these cases. That is to say, it can determine that the region R or the region L is being detected if the distance between an edge of the reference image 71 and an edge of the second images 722 running in the main scanning direction has a predetermined length.

Figure 15:
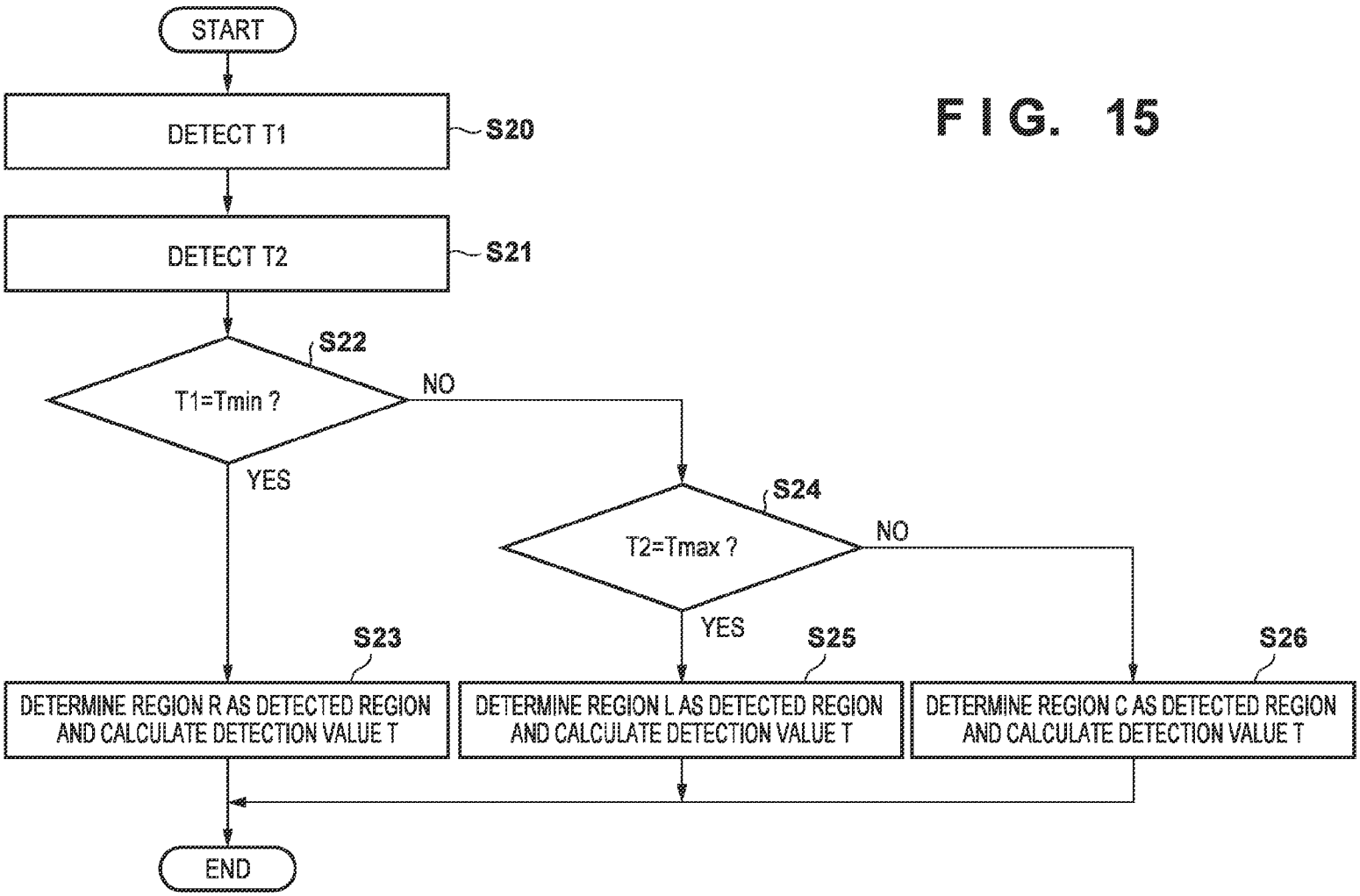
FIG. 15 is a flowchart of a process for determining a misregistration amount according to an embodiment.

A flowchart of the misregistration correction control according to the present embodiment is the same as the one shown in FIG. 5 of the first embodiment, except for the process for detecting the misregistration amount in step S12. FIG. 15 shows a flowchart of the process for detecting the misregistration amount according to the present embodiment. The control unit 1 detects the time period T1 and the time period T2 in steps S20 and S21, respectively. In step S22, the control unit 1 determines whether the time period T1 is equal to the predetermined minimum value. It should be noted that detection error may be taken into consideration in this equality determination made by comparison with the predetermined minimum value. If the time period T1 is equal to the predetermined minimum value in step S22, the control unit 1 determines that the region R is being detected and obtains the detection value T in step S23. It should be noted that the detection value T is obtained from the time periods T1, T2 and the shapes and the angles of tilt in the region C and the region R. For example, in the case where the time period T1 and the time period T2 have been detected on a line indicated by the reference sign 106 in FIG. 13, a time period indicated by the reference sign 107 is obtained as the detection value T. On the other hand, if the time period T1 is not equal to the predetermined minimum value in step S22, the control unit 1 determines whether the time period T2 is equal to the predetermined maximum value in step S24. It should be noted that detection error may be taken into consideration in this equality determination made by comparison with the predetermined maximum value. If the time period T2 is equal to the predetermined maximum value in step S24, the control unit 1 determines that the region L is being detected and obtains the detection value T in step S25. It should be noted that the detection value T is obtained from the time periods T1, T2 and the shapes and the angles of tilt in the region C and the region L. For example, in the case where the time period T1 and the time period T2 have been detected on a line indicated by the reference sign 108 in FIG. 13, a time period indicated by the reference sign 109 is obtained as the detection value T. On the other hand, if the time period T2 is not equal to the predetermined maximum value in step S24, the control unit 1 determines that the region C is being detected, and uses the time period T2 as the detection value T. Thereafter, similarly to the first embodiment, the control unit 1 calculates the misregistration amount x based on the detection value T and the moving speed of the intermediate transfer belt 30.

With the above configuration, even if the region L and the region R are in the detection region of the detection sensor 6, the misregistration amount x in the main scanning direction can be detected while maintaining the reduced size in the sub scanning direction. While the downstream edge in the region L and the upstream edge in the region R are tilted by 45 degrees with respect to the main scanning direction in the detection pattern of FIG. 13, these edges may be tilted by other angles. Also, in the case of FIG. 13, the minimum value of the time period T1 in the region L is equal to the time period T1 in the region R, and the maximum value of the time period T2 in the region R is the same as the value of the time period T2 in the region L. This allows for the configuration in which the tilt of the downstream edge in the region L is set to be different from the tilt of the upstream edge in the region R so as to avoid erroneous detection.

<Fourth Embodiment>

The present embodiment will now be described with a focus on differences from the first embodiment. In the first embodiment, even when the region L and the region R are in the detection region of the detection sensor 6, there is a possibility that the region C is determined as the detected region due to detection error. The present embodiment is intended to prevent such erroneous detection.

Figure 16:
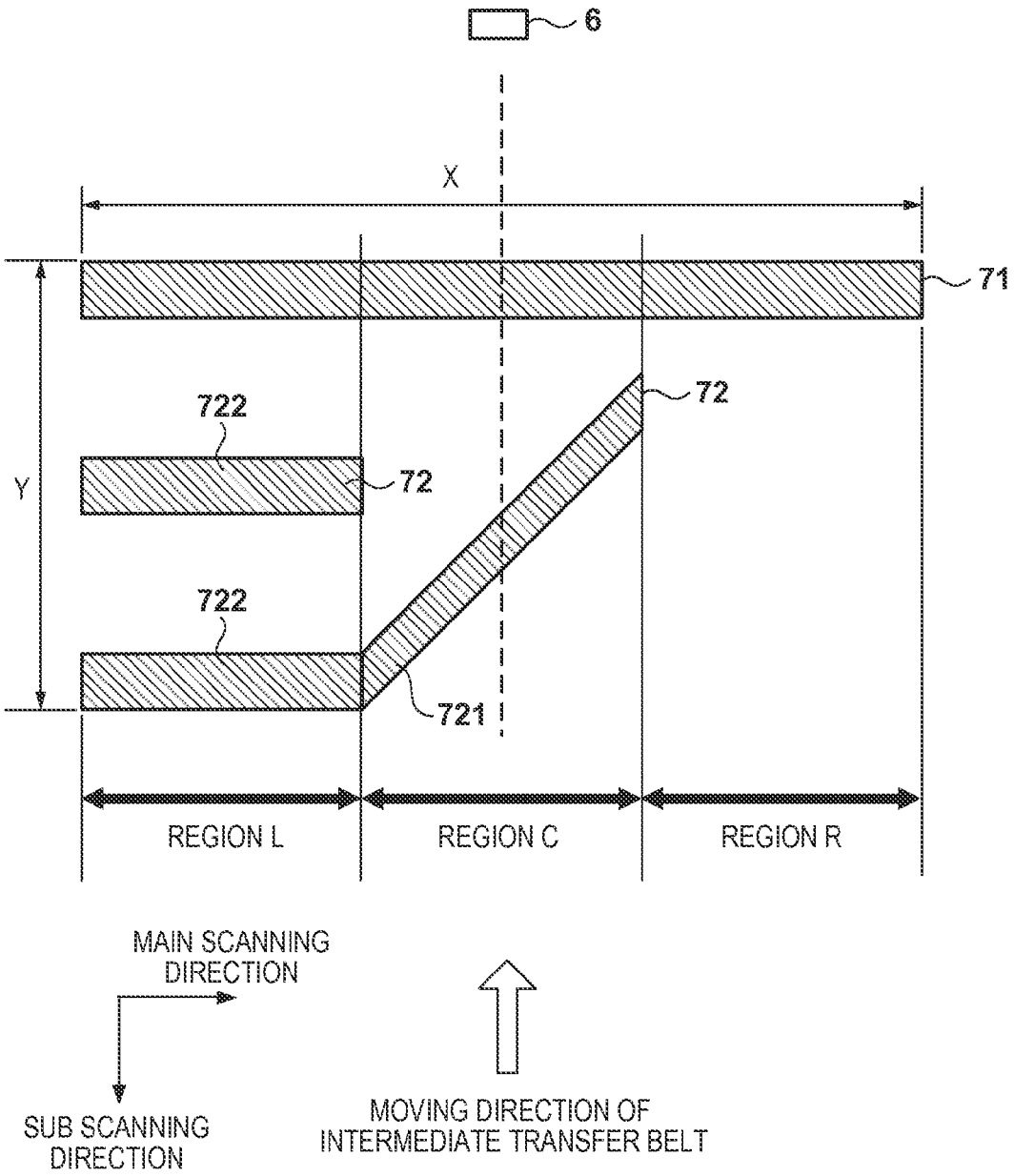
FIG. 16 shows a detection pattern according to an embodiment.

FIG. 16 shows the detection pattern according to the present embodiment. It should be noted that the present embodiment differs from the first embodiment in that the detection image 72 is formed only in the region L and the region C, and in that two detection images 72 are formed in the region L. More specifically, the first detection image 72 is obtained by eliminating the second image 722 in the region R according to the first embodiment, and the second detection image 72 that is formed only in the region L is the same as the second image 722. It should be noted that the second images 722 of the two detection images 72 may both be tilted with respect to the main scanning direction.

Figure 17:
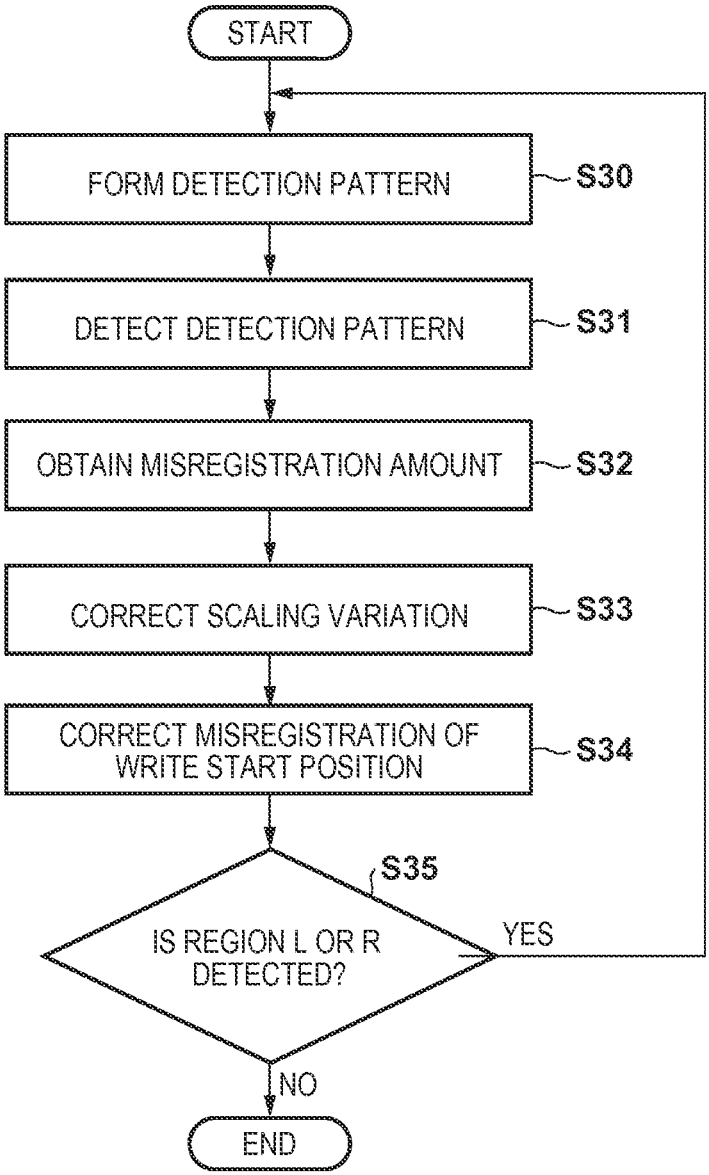
FIG. 17 is a flowchart of misregistration correction control according to an embodiment.

FIG. 17 is a flowchart of the misregistration correction control according to the present embodiment. Upon the start of the misregistration correction, the control unit 1 causes the image forming unit 41 to form the detection pattern of FIG. 16 on the intermediate transfer belt 30 in step S30. The detection sensor 6 detects the detection pattern in step S31, and the control unit 1 obtains the misregistration amount x from the detection timings of the edges of the detection pattern in step S32. It should be noted that, in the present embodiment, the control unit 1 first obtains the number of detected images from the output of the detection sensor 6. Here, while the reference image is counted toward the number of detected images in the present example, the reference image may not be counted toward the number of detected images. As is apparent from FIG. 7, the control unit 1 can determine the number of detected images by counting the number of the edges in the output of the detection sensor 6. In the case of the detection pattern of FIG. 16, when the region C is in the detection region of the detection sensor 6, the control unit 1 detects two images, that is to say, the reference image 71 and one detection image 72. When the region L is in the detection region of the detection sensor 6, the control unit 1 detects three images, that is to say, the reference image 71 and two detection images 72. When the region R is in the detection region of the detection sensor 6, the control unit 1 detects one image, that is to say, only the reference image 71. The control unit 1 can determine the detected region from the number of images detected in the above manner.

If the control unit 1 determines that the region C is being detected, it obtains the misregistration amount x in step S32 similarly to the first embodiment. If it determines that the region L is being detected, it uses a predetermined misregistration amount x as a detected misregistration amount in step S32. Here, similarly to the first embodiment, the maximum value of the misregistration amount that can be detected in the positive direction in the region C can be used as the predetermined misregistration amount used in the case where the region L is determined as the detected region. However, this predetermined misregistration amount may have a different value. If the control unit 1 determines that the region R is being detected, it uses a predetermined misregistration amount x as a detected misregistration amount in step S32. Here, similarly to the first embodiment, the maximum value of the misregistration amount that can be detected in the negative direction in the region C can be used as the predetermined misregistration amount used in the case where the region R is determined as the detected region. However, this predetermined misregistration amount may have a different value. Thereafter, similarly to the first embodiment, the control unit 1 corrects the scaling variation and the misregistration of the write start position in steps S33 and S34, and determines whether the region detected in step S31 was the region L or R in step S35. If the region detected in step S31 was the region L or R, the control unit 1 repeats the processes from step S30, similarly to the first embodiment. On the other hand, if the region detected in step S31 was the region C, the control unit 1 ends the processing.

With the above-described configuration, erroneous region detection can be prevented. In the present embodiment, two second images 722 are provided in the region L. However, a region can be finely determined by dividing the regions L and R into a plurality of sub-regions and forming different numbers of second images 722 in different sub-regions. For example, the region L is divided into sub-regions L1 and L2, and the region R is divided into sub-regions R1 and R2. The number of second images 722 in the sub-regions R2, R1, L1, and L2 can be set to zero, two, three, and four, respectively. The misregistration amount x obtained in step S32 is determined in advance for each sub-region. With this configuration, in the case where the region L and the region R have been detected, the number of times the processing of FIG. 17 is repeated can be reduced. In addition, the number of images detected in the sub-region R2, the sub-region R1, the region C, the sub-region L1, and the sub-region L2 can be set to one, two, three, four, and five, respectively, by providing an image in the region C in a different position from the first image 721 in the sub scanning direction.

It is also possible to adopt the configuration in which the region being detected is determined not by the number of detected images, but by setting one or more of the darkness, the width in the sub scanning direction, and the interval of the second images 722 to vary.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-075730, filed on Apr. 1, 2014, which is hereby incorporated by reference herein in its entirety.

What is claimed is:

1. An image forming apparatus, comprising:

a forming unit configured to form a detection pattern on a first region and a second region of an image carrier, a position of the second region being different from that of the first region in a main scanning direction;

a detection unit configured to detect the detection pattern only on the first region if an absolute value of a misregistration amount in the main scanning direction is less than a threshold, and to detect the detection pattern only on the second region if the absolute value of the misregistration amount in the main scanning direction is greater than the threshold; and a control unit configured to perform misregistration correction by obtaining a calculated misregistration amount in the main scanning direction based on a detection result of the detection pattern on the first region or the second region, wherein the detection pattern has a first edge that is tilted by a first angle with respect to the main scanning direction on the first region, and has a second edge that runs in the main scanning direction or is tilted by a second angle, which is smaller than the first angle, with respect to the main scanning direction on the second region.

2. The image forming apparatus according to claim 1, wherein a position in which the second edge is formed in a sub scanning direction includes one or both of a position of an end portion of a range in which the first edge is formed in the sub scanning direction and a position different from the range in which the first edge is formed in the sub scanning direction.

3. The image forming apparatus according to claim 1, wherein the first edge and the second edge are connected to each other at a boundary between the first region and the second region.

4. The image forming apparatus according to claim 1, wherein the detection pattern has a third edge in a position that is different from a position of the first edge in the sub scanning direction on the first region, and has a fourth edge in a position that is different from the position of the second edge in the sub scanning direction on the second region, a distance between the third edge and the first edge in the sub scanning direction changes in accordance with a positional change in the main scanning direction, and a distance between the fourth edge and the second edge in the sub scanning direction is equal to or larger than a maximum value of the distance between the third edge and the first edge in the sub scanning direction or is equal to or smaller than a minimum value of the distance between the third edge and the first edge in the sub scanning direction.

5. The image forming apparatus according to claim 4, wherein the control unit is further configured to obtain the calculated misregistration amount based on a difference between detection timings of two edges detected by the detection unit.

6. The image forming apparatus according to claim 4, wherein the distance between the fourth edge and the second edge in the sub scanning direction has a predetermined value regardless of a position in the main scanning direction.

7. The image forming apparatus according to claim 4, wherein the fourth edge and the second edge are running in the main scanning direction.

8. The image forming apparatus according to claim 4, wherein the third edge is running in the main scanning direction.

9. The image forming apparatus according to claim 4, wherein the third edge and the first edge together exhibit line symmetry with respect to the main scanning direction.

10. The image forming apparatus according to claim 1, wherein the control unit is further configured to perform the misregistration correction, cause the forming unit to form a corrected detection pattern on the image carrier after performing the misregistration correction, and perform misregistration correction again if the detection unit detects the corrected detection pattern on the second region.

11. The image forming apparatus according to claim 1, wherein the control unit is further configured to perform the misregistration correction using a predetermined misregistration amount, cause the forming unit to form a corrected detection pattern on the image carrier after performing the misregistration correction, and perform misregistration correction again if the detection unit detects the corrected detection pattern on the second region.

12. The image forming apparatus according to claim 10, wherein the control unit is further configured to repeat control for performing the misregistration correction and causing the forming unit to form a corrected detection pattern on the image carrier until the detection unit detects the corrected detection pattern on the first region.

13. The image forming apparatus according to claim 10, wherein the control unit is further configured to determine that the detection unit detects the detection pattern on the second region if the absolute value of the calculated misregistration amount obtained by the detection result of the detection pattern is equal to or larger than the threshold.

14. The image forming apparatus according to claim 1, wherein the control unit is further configured to determine, from the detection result of the detection pattern, whether the detection unit detects the detection pattern on the first region or the second region, and obtain the calculated misregistration amount based on the detection result of the detection pattern and a region that the detection unit detects.

15. The image forming apparatus according to claim 14, wherein the detection pattern has a fifth edge in a position that is different from the position of the second edge in the sub scanning direction on the second region, the fifth edge being tilted with respect to the main scanning direction.

16. The image forming apparatus according to claim 15, wherein the detection pattern has a third edge in a position that is different from a position of the first edge in the sub scanning direction on the first region, and has a fourth edge in a position that is different from the positions of the second edge and the fifth edge in the sub scanning direction on the second region, a distance between the third edge and the first edge in the sub scanning direction changes in accordance with a positional change in the main scanning direction, a distance between the fourth edge and the second edge in the sub scanning direction has a predetermined length regardless of the main scanning direction, and a distance between the fourth edge and the fifth edge in the sub scanning direction changes in accordance with a positional change in the main scanning direction.

17. The image forming apparatus according to claim 16, wherein the control unit is further configured to determine that the detection unit detects the detection pattern on the second region if the predetermined length is detected as an edge-to-edge distance in the sub scanning direction, and to determine that the detection unit detects the detection pattern on the first region if the predetermined length is not detected as the edge-to-edge distance in the sub scanning direction, and the control unit is further configured to obtain the calculated misregistration amount based on a difference between detection timings of the third edge and the first edge detected by the detection unit if the detection unit detects the detection pattern on the first region, and to obtain the calculated misregistration amount based on a difference between detection timings of the fourth edge and the fifth edge detected by the detection unit if the detection unit detects the detection pattern on the second region.

18. The image forming apparatus according to claim 16, wherein the first edge proceeds downstream in a moving direction of the image carrier toward a positive side in the main scanning direction, and the fifth edge proceeds upstream in the moving direction of the image carrier toward the positive side in the main scanning direction.

19. The image forming apparatus according to claim 1, wherein a length of the detection pattern on the second region in the sub scanning direction with the second angle is smaller than a length of the detection pattern on the second region in the sub scanning direction with the first angle.

20. The image forming apparatus according to claim 1, wherein the detection pattern has a third edge in a position that is different from a position of the first edge in the sub scanning direction on the first region, and has a fourth edge in a position that is different from the position of the second edge in the sub scanning direction on the second region, a distance between the third edge and the first edge in the sub scanning direction changes in accordance with a positional change in the main scanning direction, and a distance between the fourth edge and the second edge in the sub scanning direction changes in accordance with a positional change in the main scanning direction, and is equal to or larger than a maximum value of the distance between the third edge and the first edge in the sub scanning direction or is equal to or smaller than a minimum value of the distance between the third edge and the first edge in the sub scanning direction.

21. The image forming apparatus according to claim 20, wherein the control unit is further configured to determine whether the detection unit detects the detection pattern on the first region or the second region from a difference between detection timings of two edges detected by the detection unit.

22. The image forming apparatus according to claim 1, wherein the second region is provided at both sides of the first region in the main scanning direction.

23. The image forming apparatus according to claim 1, wherein the main scanning direction is a direction perpendicular to a rotational direction of the image carrier.

24. An image forming apparatus, comprising:

a forming unit configured to form a detection pattern on an image carrier;

a detection unit configured to detect the detection pattern; and a control unit configured to obtain a misregistration amount in a main scanning direction from a detection result of the detection pattern, and perform misregistration correction, wherein the detection pattern includes a reference image, a first image, and a second image, a distance between the reference image and the first image in a sub scanning direction changes in accordance with a position in the main scanning direction, a position of the second image is different from a position of the first image in the main scanning direction, and a distance between the reference image and the second image in the sub scanning direction is outside a distance range between the reference image and the first image in the sub scanning direction.

25. The image forming apparatus according to claim 24, wherein the control unit is further configured to perform the misregistration correction based on the misregistration amount in accordance with a distance between the reference image and the first image if the detection unit detects the first image, and to perform the misregistration correction, cause the forming unit to form a corrected detection pattern on the image carrier after performing the misregistration correction, and perform misregistration correction again if the detection unit detects the second image.

26. The image forming apparatus according to claim 25, wherein the control unit is further configured to repeat control for performing the misregistration correction and causing the forming unit to form a corrected detection pattern on the image carrier until the detection unit detects the first image.

27. The image forming apparatus according to claim 24, wherein the distance between the reference image and the second image in the sub scanning direction changes in accordance with a position in the main scanning direction, and a tilt of the second image with respect to the reference image is smaller than a tilt of the first image with respect to the reference image.

28. An image forming apparatus, comprising:

a forming unit configured to form a detection pattern on an image carrier;

a detection unit configured to detect the detection pattern; and a control unit configured to obtain a misregistration amount in a main scanning direction from a detection result of the detection pattern, and perform misregistration correction, wherein the detection pattern includes a reference image, a first image, and a second image, a distance between the reference image and the first image in a sub scanning direction changes in accordance with a position in the main scanning direction, a position of the second image is different from a position of the first image in the main scanning direction, and the second image is different from the first image in at least one of darkness, a width in the sub scanning direction, a number of images in the sub scanning direction, and an interval of images in the sub scanning direction.

29. The image forming apparatus according to claim 28, wherein the control unit is further configured to perform misregistration correction based on the misregistration amount in accordance with a distance between the reference image and the first image if the detection unit detects the first image, and to perform misregistration correction, cause the forming unit to form a corrected detection pattern on the image carrier after performing the misregistration correction, and perform misregistration correction again if the detection unit detects the second image.

30. An image forming apparatus, comprising:

a forming unit configured to form a detection pattern on an image carrier, the detection pattern including a first image and a second image, a position of the second image in a main scanning direction including a position different from a position of the first image, an angle of the second image being different from that of the first image with respect to the main scanning direction;

a detection unit configured to detect the detection pattern; and a control unit configured to perform misregistration correction based on a detection result of the detection pattern if the detection unit detects the first image, and to perform misregistration correction, cause the forming unit to form a corrected detection pattern on the image carrier after performing the misregistration correction, and perform misregistration correction again if the detection unit detects the second image.

31. The image forming apparatus according to claim 30, wherein the control unit is further configured to determine whether the detection unit detects the first image or the second image based on one of darkness, a width in a sub scanning direction, the number of images in the sub scanning direction, and an interval of images in the sub scanning direction of detected images.

32. The image forming apparatus according to claim 30, wherein the control unit is further configured to determine whether the detection unit detects the first image or the second image based on image detection timings.

33. The image forming apparatus according to claim 30, wherein the control unit is further configured to repeat control for performing the misregistration correction and causing the forming unit to form a corrected detection pattern on the image carrier until the detection unit detects the first image.

* * * * *